US011355290B2

(12) United States Patent
Arrighetti et al.

(10) Patent No.: US 11,355,290 B2
(45) Date of Patent: Jun. 7, 2022

(54) LOW VOLTAGE SWITCH POLE

(71) Applicant: ABB S.p.A., Milan (IT)

(72) Inventors: Pierantonio Arrighetti, Bossico (IT); Marco Bonfanti, Presezzo (IT)

(73) Assignee: ABB S.P.A., Milan (IT)

( * ) Notice: Subject to any disclaimer, the term of this patent is extended or adjusted under 35 U.S.C. 154(b) by 0 days.

(21) Appl. No.: 16/985,282

(22) Filed: Aug. 5, 2020

(65) Prior Publication Data

US 2021/0043396 A1 Feb. 11, 2021

(30) Foreign Application Priority Data

Aug. 5, 2019 (EP) ..... 19189944

(51) Int. Cl.
*H01H 9/30* (2006.01)
*H01H 9/34* (2006.01)

(52) U.S. Cl.
CPC ..... *H01H 9/302* (2013.01); *H01H 9/346* (2013.01)

(58) Field of Classification Search
CPC ..... H01H 1/2058; H01H 9/302; H01H 9/346; H01H 9/34; H01H 9/46; H01H 33/04; H01H 33/06; H01H 33/20; H01H 73/04; H01H 73/18
USPC ..... 218/46, 15, 30, 34, 36, 37, 40, 41, 48, 218/110
See application file for complete search history.

(56) References Cited

U.S. PATENT DOCUMENTS 5,210,385 A * 5/1993 Morel ..... H01H 9/383 218/9
5,475,193 A * 12/1995 Perdoncin ..... H01H 9/46 218/34

(Continued)

FOREIGN PATENT DOCUMENTS

CN 103762130 A 4/2014
JP H07302535 A 11/1995

(Continued)

OTHER PUBLICATIONS

European Patent Office, Extended Search Report issued in corresponding Application No. 19189944.2, dated Jan. 7, 2020, 6 pp.

*Primary Examiner* — William A Bolton
(74) *Attorney, Agent, or Firm* — Greenberg Traurig, LLP

(57) ABSTRACT

A low voltage switch pole including an insulating casing defining an internal space with a contact area and an arc extinguishing area, a fixed contact assembly and a movable contact assembly being position in the contact area, the movable contact assembly being movable between a closed position in which it is into contact with the fixed contact assembly and an open position in which it is spaced apart from the fixed contact assembly, an arc chamber including a plurality of substantially parallel metallic plates being position in the arc extinguishing area, wherein fixed contact assembly is provided with a contact support, a contact surface contacting the movable contact assembly in the closed position and positioned on the contact support, and a conductive expansion plate positioned on the contact support and extending toward the arc chamber, and wherein the fixed contact assembly is provided with a gasifying plate which is directly mounted on the conductive expansion plate.

16 Claims, 3 Drawing Sheets

(56) References Cited

U.S. PATENT DOCUMENTS

| | | | | |
|---|---|---|---|---|
| 6,417,474 | B1 * | 7/2002 | Rakus | H01H 9/46 218/148 |
| 6,924,445 | B2 * | 8/2005 | Bresciani | H01H 77/104 200/244 |
| 7,116,194 | B2 * | 10/2006 | Azzola | H01H 1/2058 335/202 |
| 7,863,537 | B2 * | 1/2011 | Shea | H01H 9/34 218/147 |
| 2013/0284702 | A1 * | 10/2013 | Hamada | H01H 33/182 218/26 |

FOREIGN PATENT DOCUMENTS

| | | | |
|---|---|---|---|
| JP | 2006059758 | A | 3/2006 |
| JP | 2006059759 | A | 3/2006 |

* cited by examiner

LOW VOLTAGE SWITCH POLE

The present invention relates to a low-voltage pole for a switching device, in particular a circuit breaker, a disconnector, or a contactor to be used in low-voltage electrical systems, i.e., systems operating at up to approximately 1000 V AC. The invention likewise relates to a low voltage switch comprising one or more of said poles.

It is known that low voltage switching devices, such as for example circuit breakers, disconnectors, contactors, limiters, hereinafter referred to, for reasons of brevity, as switches, comprise one or more electrical poles, associated to each of which there is at least one pair of contacts that can be coupled to and uncoupled from one another. Switches of the known art also comprise control means that cause relative movement of said pairs of contacts so that they can assume at least one first, coupling, position (circuit closed) and one second, separation, position (circuit open). The control means comprise, for instance, mechanisms, which terminate, for example, in a shaft operatively connected to said mobile contacts.

In particular, the circuit breakers are usually provided with a system which ensures the nominal current required for the various users, the connection and disconnection of the load, protection against any abnormal conditions (such as overloading and short-circuit) by automatically opening the circuit, and the disconnection of the protected circuit by opening the moving contacts with respect to the fixed contacts (galvanic separation) in order to achieve full isolation of the load with respect to the electric power source.

The critical function of interrupting the current (whether nominal, overload or short-circuit current) is provided by the circuit breaker in a specific portion of said circuit breaker which is constituted by the so-called deionizing arc chamber.

Thus, generally associated to each pole of a low voltage switch there is at least one arc chamber, i.e., a region of space particularly designed to foster electric-arc interruption. Arc chambers can be simple regions provided in the casing of the switch, or else can comprise various modular elements shaped, for example, like casings made of insulating material equipped with arc-breaking plates. Modular arc chambers, which are more advanced, present the advantage of being possibly replaceable and of being doable with materials that are more suitable as compared, for example, to the ones used for the casing of the switch.

During a short circuit the arc developing in the arching chamber (typically composed by arc metal plates), tends to increase its temperature, requiring cooling means to control the critical situation, especially with high range of Current and Voltage.

Typical solution provide for the use of gasifying means and/or materials, capable of releasing extinguishing substances in proximity of the area in which the electric arc is formed; these means and/or materials are typically triggered by the temperature reached when an electric arc occur. Such gasifying means are generally placed at the various location in the arc chamber and therefore the quenching effect is somehow limited and not completely satisfactory.

On the basis of the above considerations, there is a need to have available alternative technical solutions that will enable the limits and the problems set forth above to be overcome. Hence, the present disclosure is aimed at providing a low voltage switch pole which allows overcoming at least some of the above mentioned shortcomings.

In particular, the present invention is aimed at providing a low voltage switch pole in which the negative effects of an arc developing during current interruption operations are reduced at a minimum.

A further object of the present invention is to provide a low voltage switch pole in which a more effective arc quenching can be guaranteed.

A still further object of the present invention is to provide a low voltage switch pole that can be easily manufactured at industrial level, at competitive costs with respect to the solutions of the state of the art.

In order to fulfill these objects, the present invention provides a low voltage switch pole comprising an insulating casing defining an internal space with a contact area and an arc extinguishing area, a fixed contact assembly and a movable contact assembly being positioned in said contact area, said movable contact assembly being movable between a closed position in which it is into contact with said fixed contact assembly and an open position in which it is spaced apart from said fixed contact assembly, an arc chamber comprising a plurality of substantially parallel metallic plates being positioned in said arc extinguishing area.

The low voltage switch pole of the present invention is characterized in that fixed contact assembly is provided with a contact support, a contact surface contacting said movable contact assembly in the closed position and positioned on said contact support, and a conductive expansion plate positioned on said contact support and extending toward said arc chamber, and further characterized in that said fixed contact assembly is provided with a gasifying plate which is directly mounted on said conductive expansion plate.

In this way, it is possible to effectively quench the arc and limit the temperature increase due to arching phenomena.

In practice, the fixed contact of the low voltage switch of the present invention is provided with an expansion plate or horn on which a gasifying plate is mounted. Such gasifying plate co-operates with the arc extinction chamber of the low voltage switch so that hot gasses are urged and yielded through said arching chamber, and brings about an increased gasification effect, especially nearby the arc root (which represent the hottest region) nearby the fixed contact location.

Differently from the conventional solutions, where usually the gasifying means are generally placed at the arc sides, and therefore far from the arc root, with a somehow limited quenching effect, in the low voltage switch of the present invention the gasifying means are positioned directly at the arc root, close to the fixed contact.

Indeed, it has been seen that the solution of mounting the gassifying means directly at the arc root brings about two effects:

- a higher gassification effect, due to the higher temperature, since the arc root region is the hottest region;
- a pressure surge effect generated by the gasifying means at the arc root, pinching the arc cross section and increasing the electrical resistance, and therefore lowering the current peak and reducing the arching time.

In a preferred embodiment of the low voltage switch pole, according to the invention, said conductive expansion plate and said gasifying plate extend below said arc chamber.

Shape and dimensions of the gasifying plate can be selected according to the needs. However, in a further preferred embodiment of the low voltage switch pole, according to the invention, said gasifying plate protrudes beyond the outer perimeter of said conductive expansion plate, i.e. its overall dimensions are greater than those of the conductive expansion plate on which it is mounted.

In a typical embodiment of the low voltage switch pole, according to the invention, said gasifying plate has at least a first part which is positioned on said conductive expansion plate and which protrudes beyond the outer perimeter of said conductive expansion plate, said gasifying plate having a first cutout portion at the centre of said first part leaving uncovered a central portion of said conductive expansion plate.

In a preferred embodiment of the low voltage switch pole, according to the invention, the gasifying plate has a first part which is positioned on said conductive expansion plate and which protrudes beyond the outer perimeter of said conductive expansion plate; the gasifying plate has, also a second part which surrounds said contact surface.

In a further embodiment of the low voltage switch pole, according to the invention, said gasifying plate is substantially T shaped and has a first part which is positioned on said conductive expansion plate and which protrudes beyond the outer perimeter of said conductive expansion plate; the gasifying plate has also a second part which extends perpendicularly from said first portion in the direction of said contact surface.

According to this latter embodiment, in a preferred variant thereof, said gasifying plate has a first cutout portion at the centre of said first part leaving uncovered a central portion of said conductive expansion plate and a second cutout portion at the centre of said second part, said contact surface being at least partially positioned within said second cutout portion of the gasifying plate.

As previously said, shape and dimensions of the gasifying plate can be selected according to the needs. For instance, in the above described embodiments, said second cutout portion of said second part of said gasifying plate is preferably wider than said first cutout portion of said first part of said gasifying plate.

Similarly, in such embodiments, said first part of said gasifying plate is preferably wider than said second part of said gasifying plate. Different dimensioning of the gasifying plate parts and cutout portions can be however foreseen.

In a further preferred embodiment of the low voltage switch pole, according the invention, said conductive expansion plate and said gasifying plate are provided with retaining means for fixing said gasifying plate onto said conductive expansion plate.

For instance, said retaining means can advantageously comprise one or more engagement pins which are positioned on one of said conductive expansion plate or gasifying plate and corresponding one or more engagement seats for said pins which are positioned on the other of said conductive expansion plate or gasifying plate. In this way it is possible to make a very easy and quick assembly of the components.

A low voltage switch comprising a switch pole as disclosed herein is also part of the present invention.

Further features and advantages of the invention will emerge from the description of preferred, but not exclusive embodiments of the low voltage switch pole, according to the invention, non-limiting examples of which are provided in the attached drawings, wherein.

Figure 1:
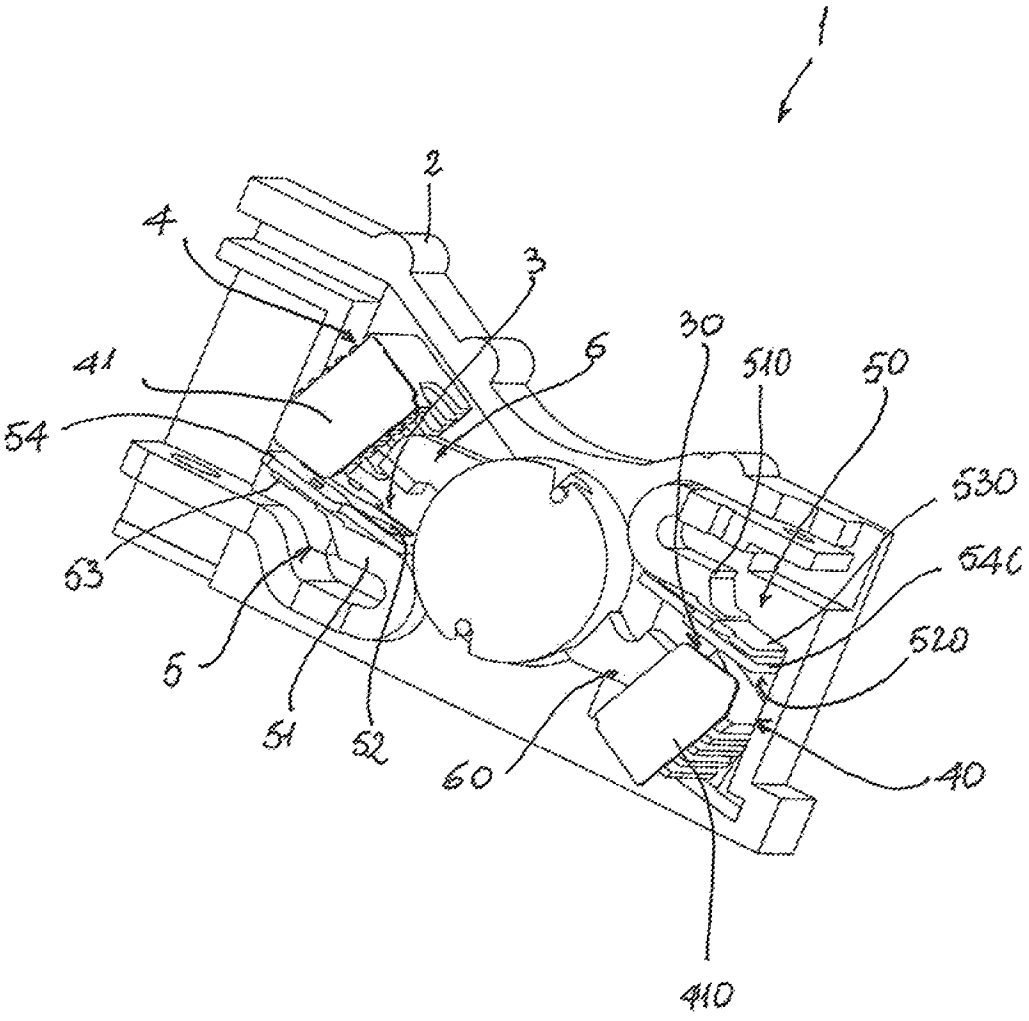
FIG. 1 is a perspective view of an embodiment of a low voltage switch pole, according to the invention.

With reference to the attached Figures, the low voltage switch pole according to the invention, designated with the reference numeral 1, comprises in its more general definition, an insulating casing 2 defining an internal space. In the embodiment shown in FIG. 1, a double interruption switch pole is represented. The present invention is not intended to be limited to such double-interruption switching technology, but it is of more general applicability.

With particular reference to FIG. 1, in the internal space of the casing 2 of the low voltage switch 1 there are provided one or more contact areas 3, 30 and a corresponding one or more arc extinguishing areas 4, 40.

A fixed contact assembly 5, 50 and a movable contact assembly 6, 60 are positioned in corresponding contact areas 3, 30. According to known technical solutions, the movable contact assembly 6, 60 is movable between a closed position, in which it is into contact with said fixed contact assembly 5, 50, and an open position, in which it is spaced apart from the corresponding fixed contact assembly 5, 50.

An arc chamber 41, 410 comprising a plurality of substantially parallel metallic plates, generally inserted in a corresponding enclosure, is conventionally positioned in said arc extinguishing area 4, 40.

In general, the operating principles and functioning, as well as the related components and mechanisms, of the a low voltage switch used in the present invention can be of the conventional type and will not be described in further details.

Figure 2:
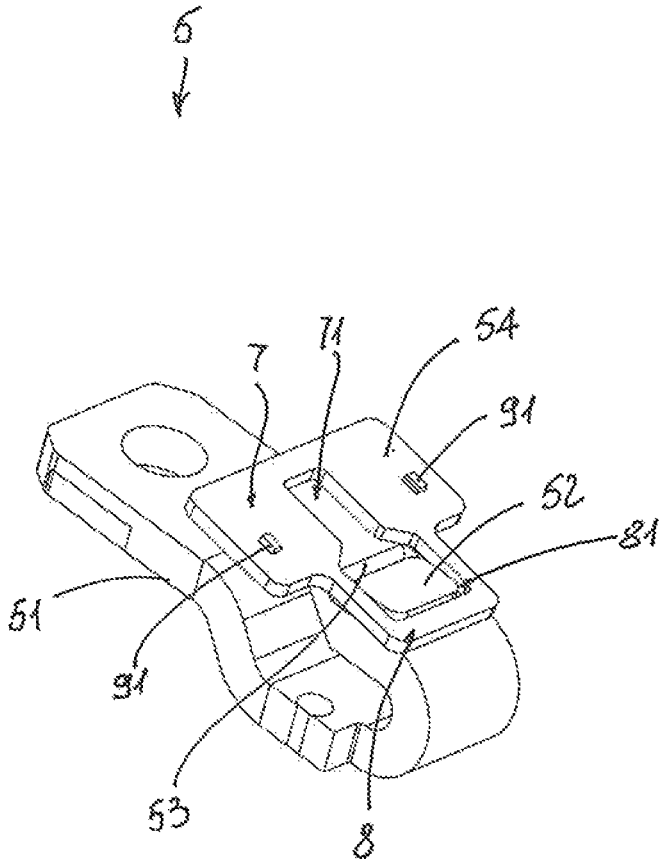
FIG. 2 is a perspective view of an embodiment of the fixed contact assembly in a low voltage switch pole, according to the invention.
Figure 3:
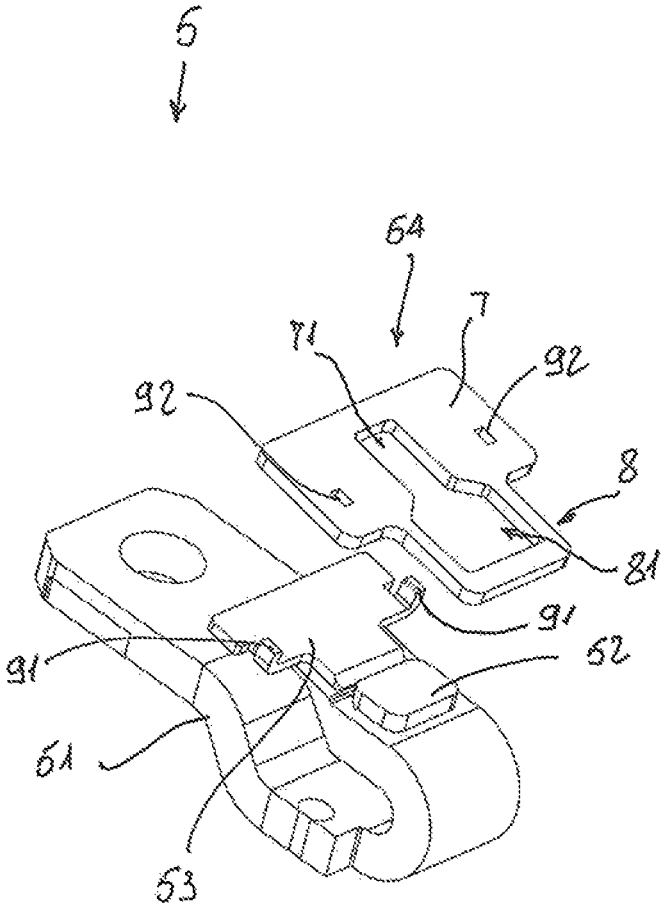
FIG. 3 is an exploded view of an embodiment of the fixed contact assembly in a low voltage switch pole, according to the invention.

With reference also to FIGS. 2 and 3, one of the distinguishing features of the low voltage switch 1 of the present invention is given by the fact that said fixed contact assembly 5, 50 is provided with a contact support 51, 510 onto which a contact surface 52, 520 is positioned. The contact surface 52, 520 comes into contact with the movable contact assembly 6, 60 in the closed position and is spaced apart therefrom in the open position of the switch 1.

The fixed contact assembly 5, 50 further comprises a conductive expansion plate 53, 530—which is also positioned on said contact support 51, 510—and which extends toward said arc chamber 41, 410.

A further distinguishing features of the low voltage switch 1 of the present invention is given by the fact that said fixed contact assembly 5, 50 is also provided with a gasifying plate 54, 540 which is directly mounted on said conductive expansion plate 53, 530.

As shown in the attached figures, the conductive expansion plate 53, 530 and the gasifying plate 54, 540 positioned thereon extend beyond said contact area 3, 30 and below said arc chamber 41, 410, so that the arc can be effectively urged from the contact areas 3, 30 to the arc extinguishing areas 4, 40.

In the embodiment shown in the attached figures, the area subtended by the gasifying plate 54, 540 is greater than the area subtended by the conductive expansion plate 53, 530. In practice, in this embodiment when the gasifying plate 54, 540 is mounted on the conductive expansion plate 53, 530, said gasifying plate 54, 540 protrudes beyond the outer perimeter of said conductive expansion plate 53, 530.

In a preferred embodiment of the voltage switch pole 1, according to the invention, the gasifying plate 54, 540 is provided with a first part 7 which is positioned on said conductive expansion plate 53, 530 and which protrudes beyond the outer perimeter of said conductive expansion plate 53, 530. Then, as shown FIGS. 2 and 3, said gasifying plate 54, 540 has a first cutout portion 71 at the center of said first part 7 which leaves uncovered a central portion of said conductive expansion plate 53, 530, providing a conductive path for the electrical arc toward the arc chamber.

In another embodiment of the low voltage switch pole 1, according to the invention, the gasifying plate 54, 540 is provided with a first part 7 which is positioned on said conductive expansion plate 53, 530 and which protrudes beyond the outer perimeter of said conductive expansion plate 53, 530. Then, as shown FIGS. 2 and 3, said gasifying plate 54, 540 is also provided with a second part 8 surrounding said contact surface 52, 520.

In a further embodiment of the low voltage switch pole 1, according to the invention, the gasifying plate 54, 540 is substantially T shaped and is provided with a first part 7 which is positioned on said conductive expansion plate 53, 530 and which protrudes beyond the outer perimeter of said conductive expansion plate 53, 530. Then, with reference to FIGS. 2 and 3, said gasifying plate 54, 540 is also conveniently provided with a second part 8 which extends perpendicularly from said first portion 7 in the direction of said contact surface 52, 520, i.e. opposite to the arc extinguishing area 4, 40.

In this latter embodiment of a low voltage switch pole 1 of the present invention, said gasifying plate 54, 540 has conveniently a first cutout portion 71 at the center of said first part 7 which leaves uncovered a central portion of said conductive expansion plate 53, 530, thereby providing a conductive path for the electrical arc toward the arc chamber. Then, the gasifying plate 54, 540 has also a second cutout portion 81 at the center of said second part 8, thereby providing a seta for said contact surface 52, 520 which is at least partially positioned within said second cutout portion 81.

In the embodiment of the low voltage switch pole 1 shown in the attached figures, said second cutout portion 81 of said second part 8 of said gasifying plate 54, 540 is wider than said first cutout portion 71 of said first part 7 of said gasifying plate 54, 540.

Likewise, in such embodiment, said first part 7 of said gasifying plate 54, 540 is wider than said second part 8 of said gasifying plate 54, 540. A different choice of shape and dimensions of gasifying plate 54, 540, as well as of the conductive expansion plate 53, 530, can also be made depending on the operating needs and design of the low voltage switch.

In atypical embodiment of a low voltage switch pole 1, according to the invention, said conductive expansion plate 53, 530 and/or said gasifying plate 54, 540 can be provided with suitable retaining means for fixing said gasifying plate 54, 540 onto said conductive expansion plate 53, 530.

For instance, with reference to the attached figures, the low voltage switch pole 1 according to the invention, can be provided with retaining means which comprise one or more engagement pins 91 positioned, e.g., on said conductive expansion plate 53, 530 and with corresponding one or more engagement seats 92 for said pins 91 which are positioned, e.g., on the gasifying plate 54, 540.

An alternative layout, i.e. with the pins 91 positioned on the gasifying plate 54, 540 and the corresponding one or more engagement seats 92 for said pins 91 which are positioned on said conductive expansion plate 53, 530, is also possible, as well as the use of alternative fixing means.

It is clear from the above that the low voltage switch pole 1 of the present invention allows solving the above underlined problems. Indeed, thanks to the proper layout of the contact area and arc extinguishing area, and in particular thanks to the proper positioning of the gasifying plate, in the low voltage switch pole 1 of the present invention there an increased gasification effect and an increased arc quenching effect, compared with the more conventional solutions of the prior art switches.

Moreover, the low voltage switch pole 1 is very simple from a mechanical standpoint and requires a limited number of components, thereby not affecting negatively the overall costs of the circuit breaker.

Several variations can be made to the low voltage switch pole 1, as well as to the low voltage switch comprising such pole, thus conceived, all falling within the scope of the attached claims. In practice, the materials used and the contingent dimensions and shapes can be any, according to requirements and to the state of the art.

The invention claimed is:

1. A low voltage switch pole, comprising:

an insulating casing defining an internal space with a contact area and an arc extinguishing area, a fixed contact assembly and a movable contact assembly being positioned in said contact area, said movable contact assembly being movable between a closed position in which said movable contact assembly is in contact with said fixed contact assembly and an open position in which said movable contact assembly is spaced apart from said fixed contact assembly, an arc chamber comprising a plurality of substantially parallel metallic plates being positioned in said arc extinguishing area, wherein said fixed contact assembly is provided with a contact support, a contact surface contacting said movable contact assembly in the closed position and positioned on said contact support, a conductive expansion plate positioned on said contact support and extending toward said arc chamber, and wherein said fixed contact assembly is provided with a gasifying plate which is directly mounted on said conductive expansion plate, wherein said gasifying plate is substantially T-shaped and has a first part positioned on said conductive expansion plate and protruding beyond an outer perimeter of said conductive expansion plate, and a second part perpendicularly extending from a first portion in a direction of said contact surface.

2. The low voltage switch pole according to claim 1, wherein said conductive expansion plate and said gasifying plate extend beyond said contact area and below said arc chamber.

3. The low voltage switch pole according to claim 2, wherein said gasifying plate having a first cutout portion at a center of said first part leaving uncovered a central portion of said conductive expansion plate.

4. The low voltage switch pole according to claim 3, wherein said gasifying plate has said first cutout portion at the center of said first part leaving uncovered said central portion of said conductive expansion plate and a second cutout portion at the center of said second part, said contact surface being at least partially positioned within said second cutout portion.

5. The low voltage switch pole according to claim 4, wherein said second cutout portion of said second part of said gasifying plate is wider than said first cutout portion of said first part of said gasifying plate.

6. The low voltage switch pole according to claim 5, wherein said first part of said gasifying plate is wider than said second part of said gasifying plate.

7. The low voltage switch pole according to claim 4, wherein said first part of said gasifying plate is wider than said second part of said gasifying plate.

8. The low voltage switch pole according to claim 4, wherein said conductive expansion plate and said gasifying plate are provided with engagement pins providing a retaining function for fixing said gasifying plate onto said conductive expansion plate.

9. The low voltage switch pole according to claim 1, wherein said conductive expansion plate and said gasifying plate are provided with engagement pins providing a retaining function for fixing said gasifying plate onto said conductive expansion plate.

10. The low voltage switch pole, according to claim 9 wherein said engagement pins providing a retaining function comprise one or more engagement pins positioned on one of said conductive expansion plate or gasifying plate and corresponding one or more engagement seats for said engagement pins positioned on an other of said conductive expansion plate or gasifying plate.

11. A low voltage switch comprising the low voltage switch pole according to claim 1.

12. The low voltage switch pole according to claim 1, wherein said gasifying plate protrudes beyond an outer perimeter of said conductive expansion plate.

13. The low voltage switch pole according to claim 12, wherein said gasifying plate has a first part positioned on said conductive expansion plate and protruding beyond the outer perimeter of said conductive expansion plate, said gasifying plate having a first cutout portion at a center of said first part leaving uncovered a central portion of said conductive expansion plate.

14. The low voltage switch pole according to claim 13, wherein said gasifying plate has a first part positioned on said conductive expansion plate and protruding beyond the outer perimeter of said conductive expansion plate, and a second part surrounding said contact surface.

15. The low voltage switch pole according to claim 1, wherein said gasifying plate has a first part positioned on said conductive expansion plate and protruding beyond an outer perimeter of said conductive expansion plate, said gasifying plate having a first cutout portion at a center of said first part leaving uncovered a central portion of said conductive expansion plate.

16. The low voltage switch pole according to claim 1, wherein said gasifying plate has a first part positioned on said conductive expansion plate and protruding beyond an outer perimeter of said conductive expansion plate, and a second part surrounding said contact surface.

* * * * *